US009500196B2

(12) United States Patent
Takeda et al.

(10) Patent No.: US 9,500,196 B2
(45) Date of Patent: *Nov. 22, 2016

(54) SCROLL COMPRESSOR WITH INTERMITTENT COMMUNICATION BETWEEN BACK PRESSURE CHAMBER AND COMPRESSION CHAMBERS

(71) Applicant: Johnson Controls-Hitachi Air Conditioning Technology (Hong Kong) Limited, Kowloon Bay KLN (HK)

(72) Inventors: Hiromu Takeda, Tokyo (JP); Masaru Ohtahara, Tokyo (JP); Shoji Matsumura, Tokyo (JP); Masashi Miyake, Tokyo (JP)

(73) Assignee: Johnson Controls-Hitachi Air Conditioning Technology (Hong Kong) Limited, Kowloon Bay (HK)

( * ) Notice: Subject to any disclaimer, the term of this patent is extended or adjusted under 35 U.S.C. 154(b) by 179 days.

This patent is subject to a terminal disclaimer.

(21) Appl. No.: 14/177,922

(22) Filed: Feb. 11, 2014

(65) Prior Publication Data

US 2014/0234148 A1 Aug. 21, 2014

(30) Foreign Application Priority Data

Feb. 21, 2013 (JP) ..... 2013-032273

(51) Int. Cl.

| | |
|---|---|
| ***F04C 29/02*** | (2006.01) |
| ***F04C 29/12*** | (2006.01) |
| ***F04C 18/02*** | (2006.01) |
| ***F04C 23/00*** | (2006.01) |

(52) U.S. Cl.

CPC ..... *F04C 29/028* (2013.01); *F04C 18/0215* (2013.01); *F04C 18/0253* (2013.01); *F04C 18/0269* (2013.01); *F04C 29/12* (2013.01); *F04C 23/008* (2013.01)

(58) Field of Classification Search

CPC ..... F04C 18/0253; F04C 29/12

See application file for complete search history.

(56) References Cited

U.S. PATENT DOCUMENTS

| | | | | |
|---|---|---|---|---|
| 5,178,527 A * | 1/1993 | Jung | F04C 29/028 418/55.6 |
| 5,370,513 A * | 12/1994 | Fain | F04C 18/0215 418/55.6 |
| 5,395,224 A * | 3/1995 | Caillat | F04C 29/023 418/55.6 |
| 6,652,238 B2 * | 11/2003 | Kajiwara | F04C 29/045 417/44.1 |

(Continued)

FOREIGN PATENT DOCUMENTS

| | | | |
|---|---|---|---|
| JP | 02130284 A | * | 5/1990 |
| JP | 2010090859 A | * | 4/2010 |
| JP | 2010-203327 A | | 9/2010 |

*Primary Examiner* — Mary A Davis

(74) *Attorney, Agent, or Firm* — Crowell & Moring LLP

(57) ABSTRACT

A scroll compressor includes a fixed scroll and an orbiting scroll. Shapes of laps of the fixed scroll and the orbiting scroll are formed by an asymmetric tooth shape in which orbiting angles of an external line side compression room formed on an external line side of the orbiting scroll lap and an internal line side compression room formed on an internal line side of the orbiting scroll lap in finishing suction differ from each other. A communicating section control groove sets communicating sections communicating the respective inlet side openings of respective fluid outflow paths and a back pressure room. The communicating sections include a first communicating section of an internal line side compression room that is shorter than a second communicating section of an external line side compression room.

5 Claims, 10 Drawing Sheets

(56) References Cited

U.S. PATENT DOCUMENTS 9,181,945 B2 * 11/2015 Takeda ..... F04C 18/0253

2011/0064596 A1 * 3/2011 Yanagase ..... F04C 18/0253
418/55.2

* cited by examiner

SCROLL COMPRESSOR WITH INTERMITTENT COMMUNICATION BETWEEN BACK PRESSURE CHAMBER AND COMPRESSION CHAMBERS

BACKGROUND

The present invention relates to a scroll compressor which is used as a refrigerant compressor for refrigeration or air conditioning, or a gas compressor of air or the like, in details, relates to a scroll compressor having an asymmetric tooth shape in which orbiting angles of a compression room configured on an external line side of an orbiting scroll lap and a compression room configured on an internal line side thereof in finishing suction differ from each other.

A scroll compressor of this kind is described in, for example, Japanese Unexamined Patent Application Publication No. 2010-203327. This patent document discloses a scroll compressor in which an oil feeding hole is configured at a lap upper face of at least one of an orbiting scroll lap and a fixed scroll lap, a first oil feeding path connecting an opening portion of the oil feeding hole and a first compression room, and a second oil feeding path connecting the opening portion of the oil feeding hole and a second compression room are configured at the lap upper face formed with the oil feeding hole, and outlets of the first oil feeding path and the second oil feeding path are provided at positions of involute angles different from each other on the lap formed with the oil feeding hole.

According to the scroll compressor described in Japanese Unexamined Patent Application Publication No. 2010-203327, it is described that necessary and sufficient amounts of oil can uniformly be fed to both of the first compression room configured on an outer wall side of the orbiting scroll lap and the second compression room formed on an inner wall side thereof.

SUMMARY

However, according to the scroll compressor of Japanese Unexamined Patent Application Publication No. 2010-203327, the oil feeding hole for making a fluid of a back pressure room flow out is provided on the upper face (tooth tip side) of the scroll lap. Therefore, a leakage loss at the lap tooth tip is increased. Also, it is necessary to provide the oil feeding path for making the fluid of the back pressure room flow out at an inner portion of the scroll lap. Therefore, there causes a problem that a strength of the lap is also deteriorated.

Incidentally, in the scroll compressor having the asymmetric tooth shape, it is also possible to avoid configuring the oil feeding path or the oil feeding hole at the scroll lap by providing the oil feeding hole to open to a tooth bottom between the scroll laps of the orbiting scroll and making the fluid of the back pressure room flow out to the compression room to thereby avoid the reduction in the strength. However, in such a case, in order to communicate the oil feeding path or the oil feeding hole with the compression room at which the back pressure of the back pressure room becomes an aimed pressure, since the orbiting angles of the external line side compression room and an internal line side compression room of the orbiting scroll lap differ from each other, the oil feeding path or the oil feeding hole can be communicated with only one compression room of the external line side compression room and the internal line side compression room. Therefore, there pose a problem that oil feeding is deficient at the compression room which does not communicate with the oil feeding hole.

Also, an oil feeding amount to the compression room effects an influence on a variation in the pressure of the back pressure room or a sealing performance in the compression room. Therefore, the pressure in the back pressure room can be stabilized and the sealing performance in the compression room can sufficiently be ensured by making the oil feeding amount to the compression room proper, thereby, a compressor efficiency can be improved.

It is an object of the present invention to provide a scroll compressor which can make oil feeding amounts to an external line side compression room and an internal line side compression room of an orbiting scroll lap proper without deteriorating a strength of the lap.

In order to achieve the above-described object, the present invention is a scroll compressor configuring a suction room and a compression room between a fixed scroll and an orbiting scroll by bringing the fixed scroll and the orbiting scroll configured by erecting laps in a spiral shape on base plates in mesh with each other, reducing to press a volume of the compression room by moving to orbit the orbiting scroll, and having a back pressure room a pressure of which is higher than a pressure of the suction room on a back face of the base plate of the orbiting scroll, in which shapes of the laps of the fixed scroll and the orbiting scroll are configured by an asymmetric tooth shape in which orbiting angles of an external line side compression room configured on an external line side of the orbiting scroll lap and an internal line side compression room configured on an internal line side of the orbiting scroll lap in finishing suction differ from each other, in which a fluid outflow path for the external line side compression room communicating with the external line side compression room of the orbiting scroll lap, and a fluid outflow path for the internal line side compression room communicating with the internal line side compression room of the orbiting scroll lap are configured on the base plate of the orbiting scroll, in which openings on outlet sides of the respective fluid outflow paths are configured to open to a lap tooth bottom of the orbiting scroll configuring the compression room, in which openings on inlet sides of the respective fluid outflow paths are configured to open to a face of the base plate of the orbiting scroll sliding in contact with a sliding face of the base plate of the fixed scroll, in which a face of the base plate of the fixed scroll in contact with the base plate of the orbiting scroll is configured with a communicating section control groove for intermittently communicating the respective inlet side openings of the fluid outflow path for the external line side compression room and the fluid outflow path for the internal line side compression room and the back pressure room in accordance with a movement of orbiting the orbiting scroll, and in which the communicating section control groove is configured to set communicating sections communicating the respective inlet side openings of the respective fluid outflow paths and the back pressure room such that pressures in the external line side compression room in starting to communicate and finishing to communicate the external side compression room and the back pressure room become the same as pressures in the internal line side compression room in starting to communicate and in finishing to communicate the internal line side compression room and the back pressure room or fall within a previously determined allowable value.

Or, the communicating section control groove is configured to set the communicating sections communicating the respective inlet side openings of the respective fluid outflow paths and the back pressure room such that a ratio of a time period of communicating the external line side compression room and the back pressure room to a time period of communicating the internal line side compression room and the back pressure room becomes the same as a ratio of an external line length to an internal line length of the lap of the orbiting scroll configuring the respective compression rooms or falls within a previously determined allowable value.

The present invention achieves an effect of capable of providing a scroll compressor which can make amounts of feeding oil to the external line side compression room and the internal line side compression room of the orbiting scroll lap proper without deteriorating a strength of the lap.

DETAILED DESCRIPTION

An explanation will be given of a specific embodiment of the present invention in reference to the drawings as follows.

First Embodiment

An explanation will be given of a first embodiment of a scroll compressor according to the present invention in reference to FIG. 1 through FIG. 6.

Figure 1:
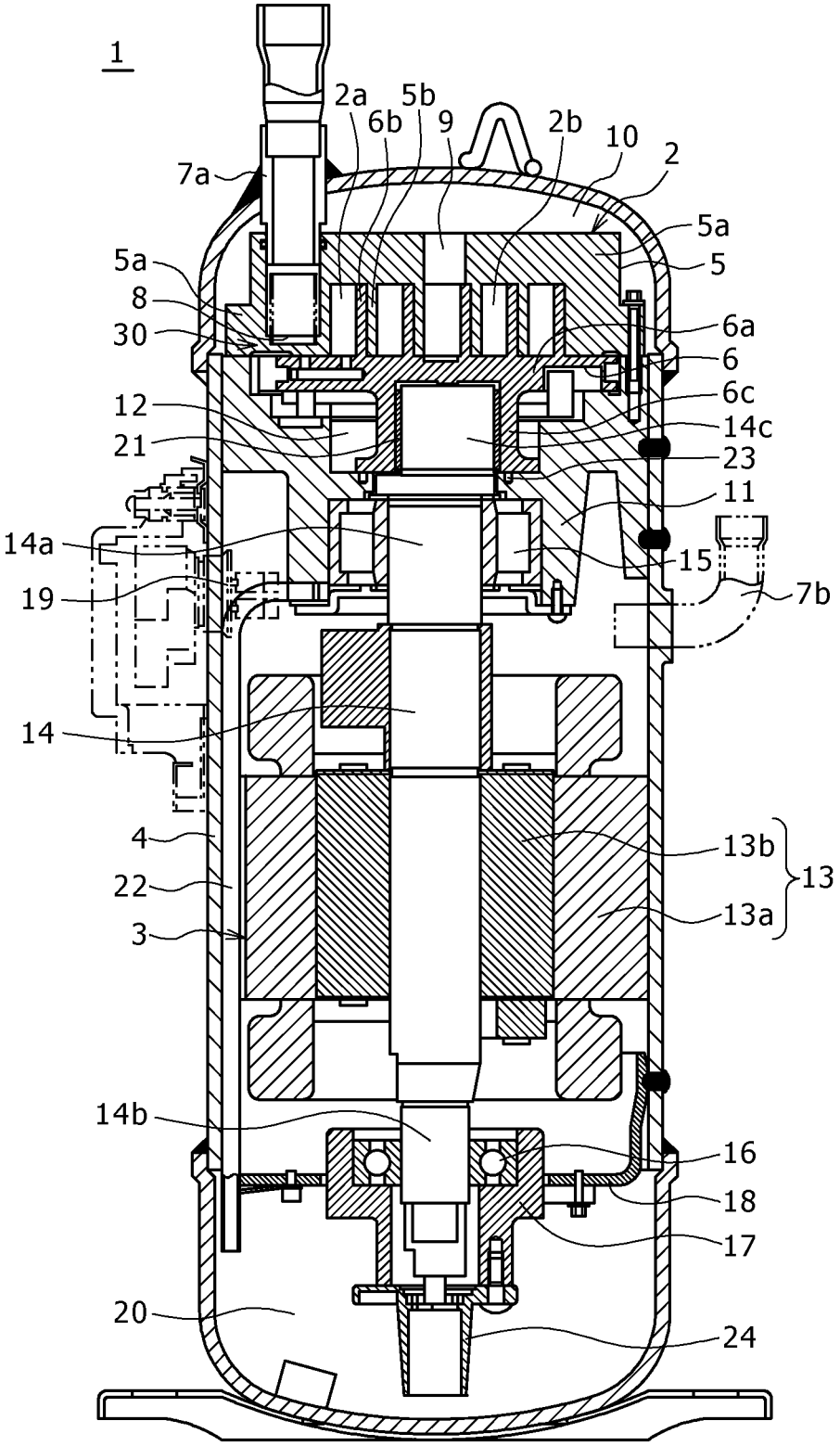
FIG. 1 is a vertical sectional view showing a first embodiment of a scroll compressor according to the present invention.

FIG. 1 is a vertical sectional view showing the first embodiment of the scroll compressor according to the present invention, showing a total structure of the scroll compressor. The scroll compressor 1 of the present embodiment is configured by containing a compressing unit 2 arranged at an upper portion and a driving unit 3 arranged at a lower portion for driving the compressing unit in a hermetically closed vessel 4.

The compressing unit 2 is configured by bringing a fixed scroll 5 configured by erecting a lap 5*b* in a spiral shape on a base plate 5*a*, and an orbiting scroll 6 configured by erecting a lap 6*b* in a spiral shape on a base plate 6*a* in mesh with each other. Thereby, an external line side compression room 2*a* and an internal line side compression room 2*b* of the orbiting scroll lap 6*b* are configured between the both scrolls 5 and 6. A working fluid (for example, gas refrigerant) is sucked to the compression rooms 2*a* and 2*b* from a suction tube 7*a* via a suction space 8, the working gas is compressed by reducing volumes of the compression rooms 2*a* and 2*b*, and is delivered to a delivery space 10 from a delivery port 9 at a center by moving to orbit the orbiting scroll 6 by the driving unit 3. The working gas delivered to the delivery space 10 flows into a space arranged with the driving unit 3 via a path (not illustrated) configured between a frame 11 attached with the fixed scroll 5 of the compression unit 2, and the hermetically closed vessel 4 fixedly installed with the frame 11, and is delivered to outside of the hermetically closed vessel 4 via a delivery tube 7*b* provided at the hermetically closed vessel 4.

A back pressure room 12, a pressure of which is higher than that of the suction space 8 and is lower than that of the delivery space 10, is formed between the base plate 6*a* of the orbiting scroll 6 and the frame 11, that is, at a back face of the base plate of the orbiting scroll 6.

The driving unit 3 is configured by a motor 13 configured by a stator 13*a* and a rotor 13*b*, a crankshaft 14 integrally coupled with a center of the rotor 13*b*, a main bearing 15 provided at the frame 11 for rotatably supporting a main shaft portion 14*a* on an upper portion side of the crankshaft 14, a sub-bearing 16 for supporting a sub shaft portion 14*b* on a lower portion side of the crankshaft 14, a sub-bearing housing 17 provided with the sub-bearing 16, a sub frame 18 attached with the sub-bearing housing 17 and fixedly installed to the hermetically closed vessel 4, and the like as basic elements.

The motor 13 is driven by an electric input from an inverter (not illustrated) or the like supplied via an electric terminal 19 and rotates the crankshaft 14. An eccentric shaft portion 14*c* is provided on an upper end side of the crankshaft 14, and the eccentric shaft portion 14*c* is inserted into an orbiting boss portion 6*c* provided at a center of the back face of the orbiting scroll 6, and moves to orbit the orbiting scroll 6. According to the present embodiment, a ferrite magnet is used for the rotor of the motor.

An oil basin 20 for storing a lubricant (also referred to simply as oil) is configured at a lower portion in the hermetically closed vessel 4. A delivery pressure is operated to the oil of the oil basin 20, and the oil in the oil basin 20 is fed to a space in the orbiting boss portion 6*c* (orbiting boss portion space) between the orbiting boss portion 6*c* of the orbiting scroll and the eccentric shaft portion 14*c* via an oil feeding path (not illustrated) configured in the crankshaft 14 by using a pressure difference between the oil basin 10 and a compressor suction side. The oil fed to the orbiting boss portion space lubricates an orbiting bearing 21 provided at the orbiting boss portion 6*c*, thereafter, flows to the main bearing 15, and the oil after lubricating the main bearing 15 returns again to the oil basin 20 by passing an oil discharge pipe 22.

A portion of the oil in the orbiting boss portion space is fed to the back pressure room 12 via a seal provided between a lower end face of the orbiting boss portion 6*c* and the frame 11 and an oil transporting mechanism 23 of pressure difference oil feeding or the like utilizing a pressure difference. The oil fed to the back pressure room 12 is configured to be fed to the compression rooms 2*a* and 2*b* via a back pressure room fluid flow out mechanism portion 30 configured at the base plate 5*a* of the fixed scroll 5 and the base plate 6*a* of the orbiting scroll 6.

It is necessary to maintain a hermetically closing performance of the compression rooms 2*a* and 2*b* by pressing the orbiting scroll 6 to the fixed scroll 5 in a compressing operation of the scroll compressor 1. For that purpose, a pressure of the back pressure room 12 (back pressure) is made to be a pressure between a delivery pressure and a suction pressure (that is, an intermediate pressure lower than the delivery pressure and higher than the suction pressure). Thereby, the intermediate pressure can be operated to the back face of the base plate 6*a* of the orbiting scroll 6, and the orbiting scroll 6 can be pressed to the fixed scroll 5 by a pertinent pressure.

According to the present embodiment, when pressure states in the compression rooms 2*a* and 2*b* fall within aimed pressure ranges, the compression rooms 2*a* and 2*b* pressures of which fall in the aimed pressure ranges and the back pressure room 12 are communicated via the back pressure room fluid flow out mechanism portion 30 such that the pressure of the back pressure room 12 becomes pertinent. Thereby, the pressure of the back pressure room 12 can be maintained at a pertinent pressure, and energy loss can be reduced by preventing a back flow (back flow from a high pressure side to a low pressure side) of the working gas owing to a deficiency in a force of pressing the orbiting scroll 6 to the fixed scroll 5. Also, an increase in a sliding loss (energy loss) by making the pressing force excessive can be avoided. The oil can firmly fed to both of the external line side compression room 2*a* and the internal line side compression room 2*b*, and therefore, the sliding portion of the fixed scroll 5 and the orbiting scroll 6 can firmly be lubricated, and a deficiency in oil feeding can be prevented. Therefore, the reliability of the scroll compressor can be ensured.

As described above, the oil in the oil basin 20 is not only fed to lubricate the respective bearing portions 15, 16, and 21, but also lubricate the sliding portion of the fixed scroll 5 and the orbiting scroll 6 by also being fed to the compression rooms 2*a* and 2*b*, and also carries out a sealing operation of the sliding portion of the fixed scroll 5 and the orbiting scroll 6. It can be restrained that the working gas in the compression room on a low pressure side is heated, or the operating gas is recompressed by leaking the working fluid in the respective compression rooms 2*a* and 2*b* to the compression room on the low pressure side, and occurrence of energy loss thereby can be reduced by the sealing operation.

Incidentally, numeral 24 designates an oil feeding pump of a volume type which is provided for pressurizing a deficient amount for feeding the oil in the oil basin 20 to the orbiting boss portion space, and feeding the oil to the sub-bearing 16.

According to the scroll compressor 1 in the present embodiment, the lap shapes of the fixed scroll 5 and the orbiting scroll 6 are configured by the asymmetric tooth type in which orbiting angles of the external line side compression room 2*a* configured on an external line side of the orbiting scroll lap 6*b* and the internal line side compression room 2*b* configured on the internal line side in finishing suction differ from each other. According to the scroll compressor having the asymmetric tooth type, an enclosing volume of the external line side compression room 2*a* of the orbiting scroll lap 6*b* is larger than an enclosing volume of the internal line side compression room 2*b*. Therefore, orbiting angles of the compression rooms (compression rooms brought in the aimed pressure state) 2*a* and 2*b* communicated for bringing the pressure of the back pressure room 12 into the aimed pressure differ from each other between the external line side compression room 2*a* and the internal line side compression room 2*b* of the orbiting scroll lap 6*b*.

Figure 2:
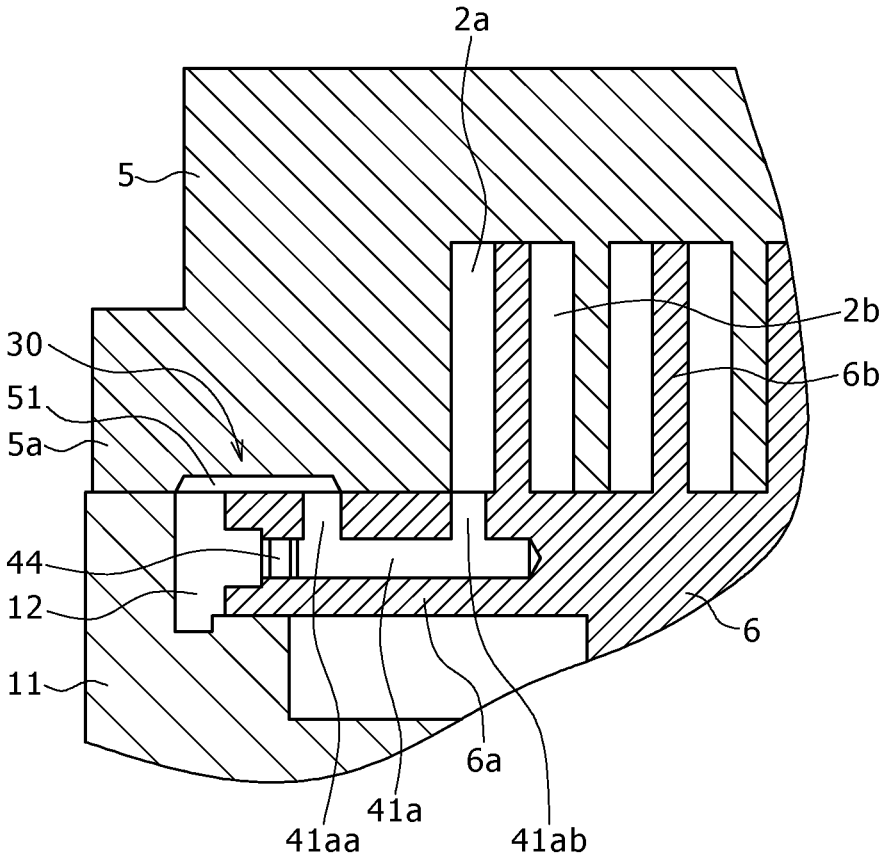
FIG. 2 is a sectional view of an essential portion showing to enlarge a vicinity of a back pressure room fluid flow out mechanism portion shown in FIG. 1.

A detailed explanation will be given of a configuration of the back pressure room fluid flow out mechanism portion 30 in reference to FIG. 2 through FIG. 4. FIG. 2 is a sectional view of an essential portion showing to enlarge a vicinity of the back pressure room fluid flow out mechanism portion shown in FIG. 1, and FIG. 3 and FIG. 4 are sectional views showing a state of bringing the fixed scroll and the orbiting scroll of the scroll compressor shown in FIG. 1 in mesh with each other, FIG. 3 is a view showing a state of communicating the back pressure room and the external line side compression room, and FIG. 4 is a view showing a state of communicating the back pressure room and the internal line side compression room.

Figure 3:
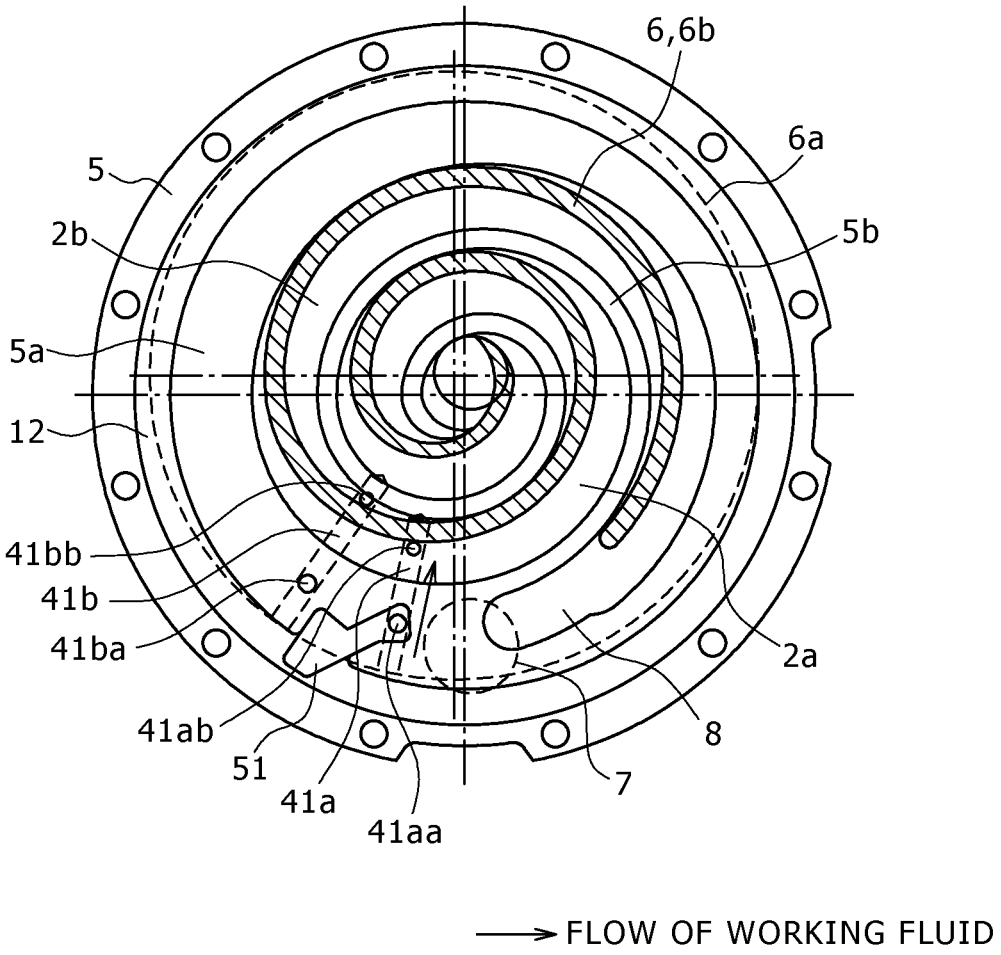
FIG. 3 is a sectional view showing a state of bringing a fixed scroll and an orbiting scroll of the scroll compressor shown in FIG. 1 in mesh with each other, and is a view showing a state of communicating a back pressure room and an external line side compression room.
Figure 4:
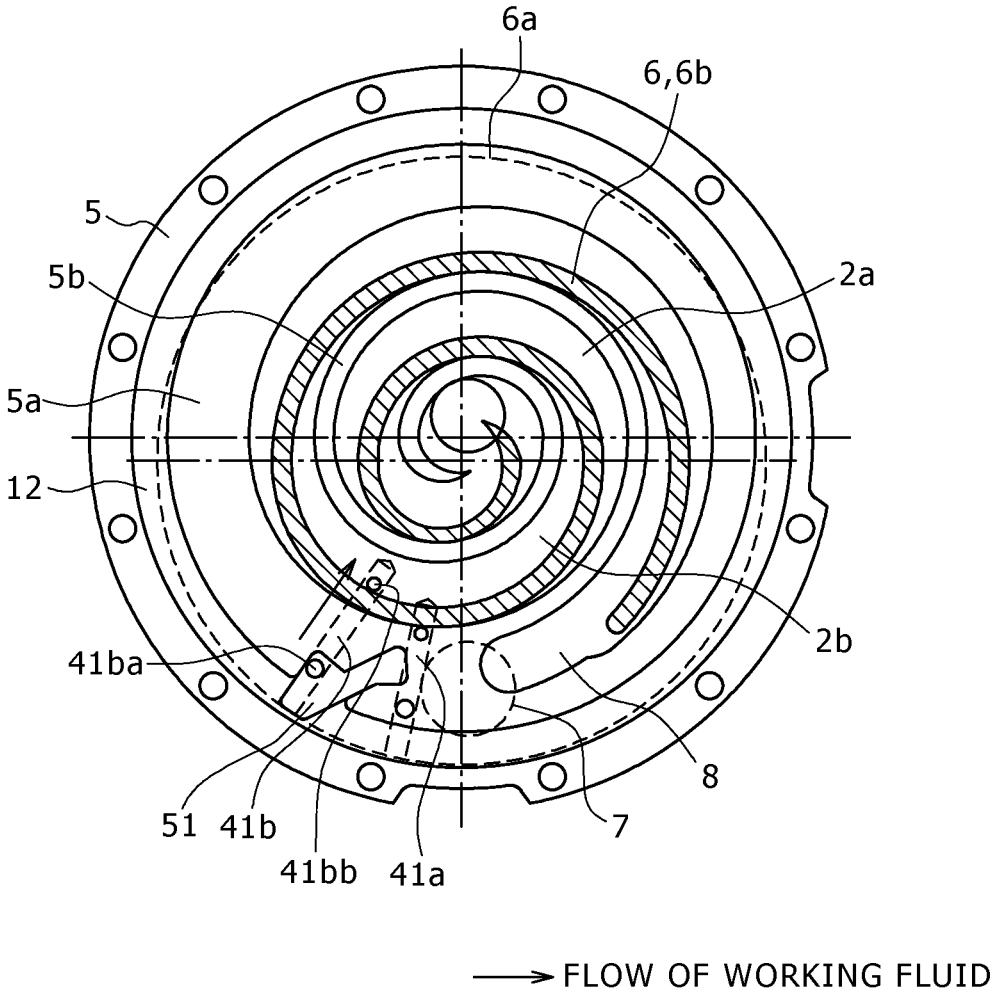
FIG. 4 is a sectional view showing a state of bringing the fixed scroll and the orbiting scroll of the scroll compressor shown in FIG. 1 in mesh with each other, and is a view showing a state of communicating the back pressure room and an internal line side compression room.

As shown in FIG. 2 through FIG. 4, the base plate 6*a* of the orbiting scroll 6 is configured with a fluid outflow path 41*a* for the external line side compression room communicating with the external line side compression room 2*a* of the orbiting scroll lap 6*b*, and a fluid outflow path 41*b* for the internal line side compression room communicating with the internal line side compression room 2*b* of the orbiting scroll lap 6*b* (refer to FIG. 3, FIG. 4). The respective fluid outflow paths 41*a* and 41*b* are respectively configured with inlet side openings 41*aa* and 41*ba* and outlet side openings 41*ab* and 41*bb*. Incidentally, numeral 44 shown in FIG. 2 designates a closing member which closes an opening end on an external diameter side produced when the fluid outflow path 41*a* (similar to 41*b*) is configured to hamper the fluid outflow path 41*a* from always communicating with the back pressure room 12.

The outlet side opening 41*ab* of the fluid outflow path 41*a* for the external line side compression room is configured at a lap tooth bottom of the orbiting scroll 6 configuring the external line side compression room 2*a*. Also, the outlet side opening 41*bb* of the fluid outflow path 41*b* for the internal line side compression room is configured at a lap tooth bottom of the orbiting scroll 6 configuring the internal line side compression room 2*b*.

The inlet side openings 41*aa* and 41*ba* of the respective fluid outflow paths 41*a* and 41*b* are configured to open to a face of the base plate 6*a* of the orbiting scroll 6 sliding in contact with a sliding face of the base plate 5*a* of the fixed scroll 5.

On the other hand, the base plate 5*a* of the fixed scroll 5 is configured with a communication section control groove 51 at a face of the base plate 5*a* (base plate face) in contact with the base plate 6*a* of the orbiting scroll 6. The communication section control groove 51 intermittently communicates the respective inlet side openings 41*aa* and 41*ba* of the fluid outflow path 41*a* for the external side compression room 2*a* and the fluid outflow path 41*b* for the internal line side compression room 2*b* and the back pressure room 12 in accordance with an orbiting movement of the orbiting scroll 6.

That is, the communicating section control groove 51 is configured at a position of intermittently communicating the inlet side opening 41*aa* of the fluid outflow path 41*a* for the external line side compression room and the back pressure room 12 in accordance with the orbiting movement of the orbiting scroll (refer to FIG. 3). Also, the communicating section control groove 51 is configured at a position of intermittently communicating the inlet side opening 41*ba* of the fluid outflow path 41*b* for the internal line side compression room and the back pressure room 12 in accordance with the orbiting movement of the orbiting scroll (refer to FIG. 4). Thereby, the back pressure room 12 and the external line side compression room 2*a* as well as the external line side compression room 2*b* can respectively be communicated with each other intermittently.

Incidentally, according to the present embodiment, an explanation has been given of an example of configuring the communicating section control groove for intermittently communicating the back pressure room 12 and the external line side compression room 2*a* and the communicating section control groove for intermittently communicating the back pressure room 12 and the internal line side compression room 2*b* by the common single communicating section control groove 51. However, the communicating section control groove for intermittently communicating the back pressure room 12 and the external line side compression room 2*a*, and the communicating section control groove for intermittently communicating the back pressure room and the internal line side compression room 2*b* may be configured by two separate grooves which do not communicate with each other.

The inlet side opening 41*aa* or 41*ba* is closed by the base plate 5*a* of the fixed scroll 5 and the communication between the back pressure room 12 and the compression room 2*a* or 2*b* is hampered at a certain section in accordance with the orbiting movement of the orbiting scroll 6 by configuring the inlet side openings 41*aa* and 41*ba* of the fluid outflow paths 41*a* and 41*b* as described above. Also, the back pressure room 12 and the compression room 2*a* or 2*b* can be communicated with each other by the presence of the inlet side opening 41*aa* or 41*ba* at a position of the communicating section control groove 51 configured at the base plate 5*a* of the fixed scroll 5 at another certain section.

Also, the communicating section control groove 51 is configured such that the back pressure room 12 and the external line side compression room 2*a* as well as the internal line side compression room 2*b* intermittently communicate with each other within ranges of orbiting angles at which pressures of the respective compression rooms 2*a* and 2*b* are brought into aimed pressure states.

That is, a configuring position and a shape of the communicating section control groove 51 are determined such that the compression room 2*a* or 2*b* which is brought into a pressure state equivalent to the aimed pressure, and the back pressure room 12 communicate with each other via the fluid outflow path 41*a* or 41*b* only at a section at which the pressure state of the external line side compression room 2*a* or the internal line side compression room 2*b* becomes equivalent to each aimed pressure (refer to FIG. 3, FIG. 4).

The oil of the oil basin 20 at a pressure equivalent to the delivery pressure flows into the back pressure room 12 by the oil transporting mechanism 23 of pressure difference oil feeding or the like provided at the orbiting scroll 6 (refer to FIG. 1), and therefore, the pressure of the back pressure room 12 is going to be a pressure equivalent to the delivery pressure. However, the working fluid of the oil or a working gas or the like in the back pressure room 12 is fed into the compression rooms 2*a* and 2*b* by pressure differences between the pressure in the back pressure room 12 and the pressures in the compression rooms 2*a* and 2*b* which are brought into the communicating state by intermittently communicating the back pressure room 12 and the compression rooms 2*a* and 2*b* via the fluid outflow paths 41*a* and 41*b* and the communicating section control groove 51. Thereby, the pressure of the back pressure room 12 is maintained at a pressure substantially equivalent to the pressures in the compression rooms 2*a* and 2*b*.

In the scroll compressor of the asymmetric tooth shape described above, the orbiting angles of the external side compression room 2*a* and the internal line side compression room 2*b* in finishing suction differ from each other, and therefore, pressures in the external line side compression room 2*a* and the internal line side compression room 2*b* at a certain orbiting angle differ from each other. Therefore, in a case where the back pressure room 12 and the respective compression rooms 2*a* and 2*b* are simultaneously communicated, the oil can be fed only to either of the compression rooms 2*a* and 2*b* on a low pressure side, and the working fluid in the compression room flows back to the side of the back pressure room 21, and oil feeding becomes deficient or compression is deficient at the compression room 2*a* or 2*b* on a high pressure side.

Hence, according to the present embodiment, the communicating section control groove 51 is configured such that the external line side compression room 2*a* and the internal line side compression room 2*b* can communicate with the back pressure room 12 independently at different timings.

Also, it is necessary to properly set the respective communicating sections of the orbiting external line compression room 2*a* and the orbiting internal line side compression room 2*b* such that the oil can respectively be fed to the orbiting external line side compression room 2*a* and the orbiting internal line side compression room 2*b* by communicating the fluid outflow paths 41*a* and 41*b* and the communicating section control groove 51 only when the pressures of the respective compression rooms 2*a* and 2*b* respectively become aimed pressures. Furthermore, the respective communicating sections need to be able to ensure a stable pressure of the back pressure room and to be able to ensure stable back pressure room pressure and to feed oil to the respective compression rooms 2*a* and 2*b* by proper oil feeding amounts.

Figure 5:
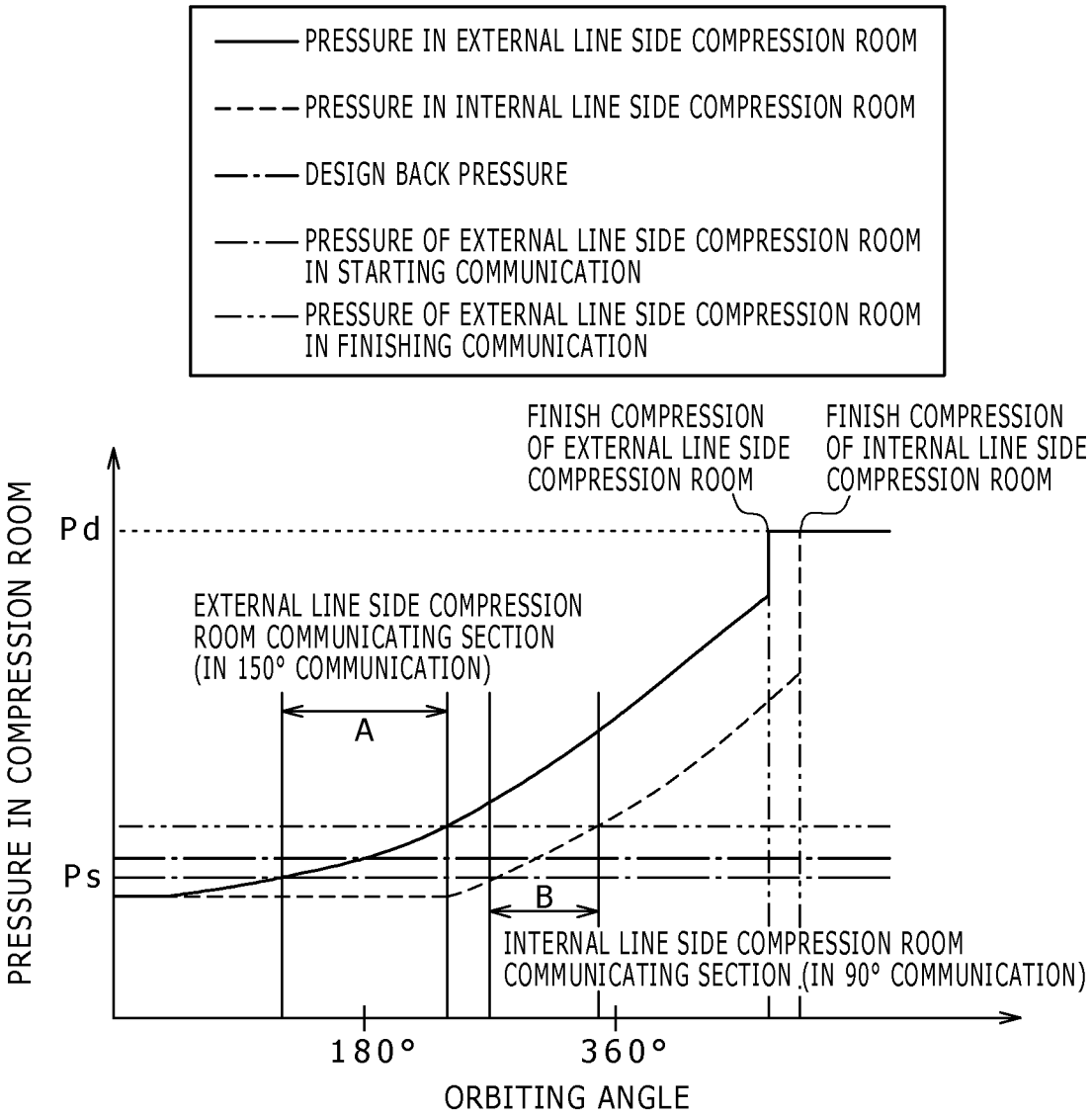
FIG. 5 is a diagram for explaining a relationship between an orbiting angle and a pressure in a compression room in the scroll compressor according to the present invention, and is a diagram for explaining a communicating section of a back pressure room fluid outflow path.

According to the present embodiment, the communicating sections are configured as shown in FIG. 5 in order to realize the necessity. That is, the communicating section control groove 51 is configured such that the section of communicating the external line side compression room 2*a* with the back pressure room 12 and the section of communicating the internal line side compression room 2*b* with the back pressure room 12 become communicating sections shown in FIG. 5.

Figure 6:
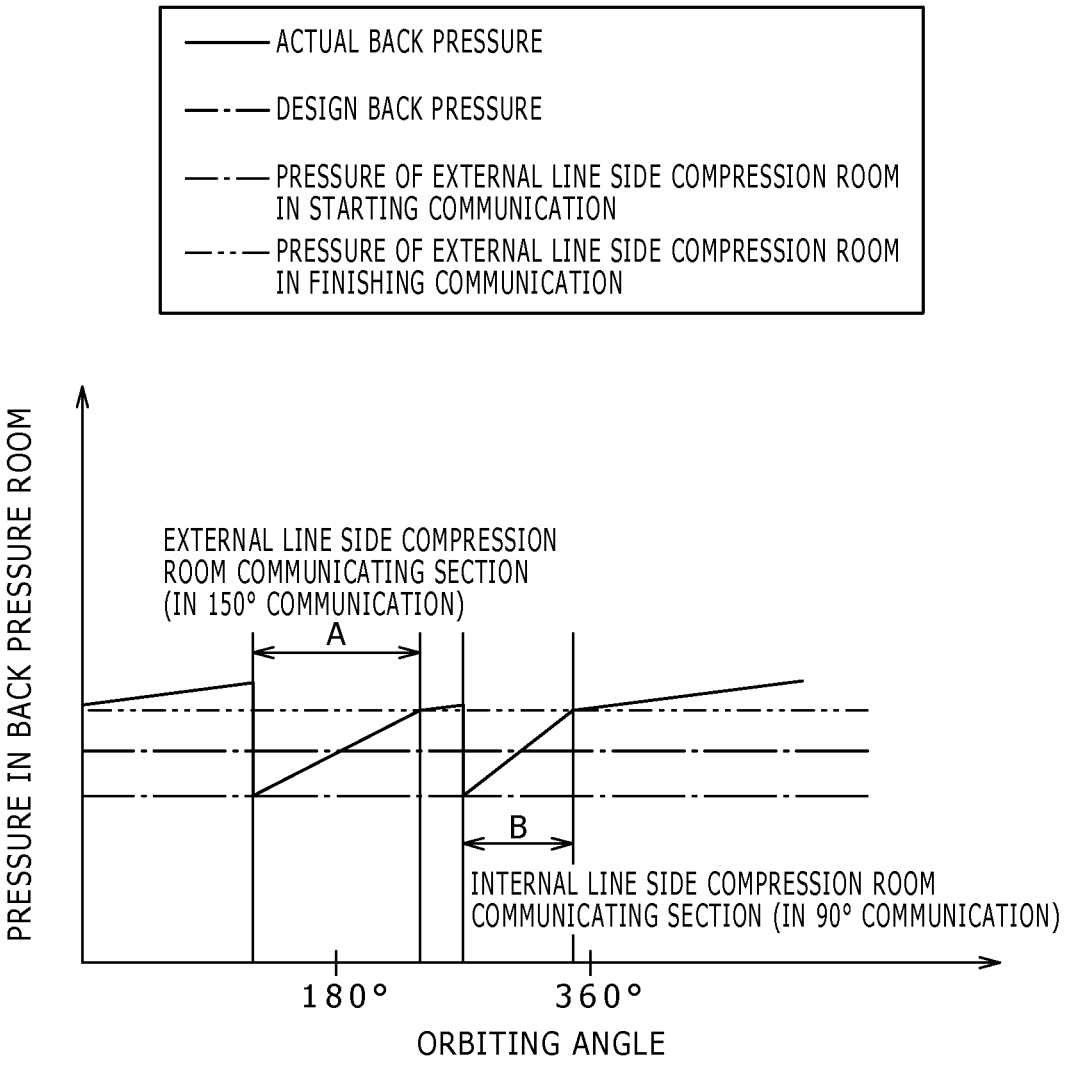
FIG. 6 is a diagram for explaining a relationship between the orbiting angle and a pressure in a back pressure room in the scroll compressor according to the present invention.

A detailed explanation will be given of the configuration in reference to FIG. 5 and FIG. 6 as follows. FIG. 5 is a diagram for explaining a relationship between the orbiting angle of the scroll compressor and the pressure in the compression room of the present embodiment, and is a diagram for explaining the communicating section of the back pressure room fluid outflow path, and FIG. 6 is a diagram for explaining a relationship between the orbiting angle and the pressure in the back pressure room in the scroll compressor of the present invention.

In FIG. 5, a bold line indicates a change in a pressure in the external line side compression room 2*a* in correspondence with the orbiting angle of the orbiting scroll 6, a broken line similarly indicates a change in a pressure in the internal line side compression room 2*b*, a bold one-dotted chain line indicates a design pressure (design back pressure) of the back pressure room 12, a one dotted chain line indicates the pressure in the compression room when the external line side compression room 2*a* starts communicating with the back pressure room 12, and a two-dotted chain line indicates the pressure in the compression room when the external line side compression room 2*a* finishes communicating with the back pressure room 12. Further, notation Ps indicates a suction pressure, and notation Pd indicates a delivery pressure (refer to dotted line in the drawing).

According to the present embodiment, the external line side compression room 2*a* is configured to communicate with the back pressure room 12 at section A (in the present embodiment, the communicating section is about 150°) where the pressure of the external line side compression room 2*a* falls within an aimed pressure range (a range where the pressure becomes a pressure equivalent to the design back pressure). On the other hand, a configuring position and a shape of the communicating section control groove 51 are determined such that the internal line side compression room 2*b* also communicates with the back pressure room 12 at section B (in the present embodiment, the communicating section is about 90°) so that the aimed pressure range of the internal line side compression room 2*b* becomes the same as the aimed pressure range of the external line side compression room 2*a*.

That is, the sections of communicating the respective inlet side openings 41*aa* and 41*ba* of the respective fluid outflow paths 41*a* and 41*b* with the back pressure room 12 (communicating sections A and B described above) are configured to be controlled by the communicating section control groove 51 such that the pressures in the external line side compression room in starting to communicate and in finishing to communicate the external line side compression room 2*a* with the back pressure room 12, and pressures in the internal line side compression room in starting to communicate and in finishing to communicate the internal line side compression room 2*b* with the back pressure room 12 become substantially the same pressures.

Incidentally, although it is preferable that the pressures in the respective compression rooms 2*a* and 2*b* in starting to communicate and in finishing communicating the both compression rooms 2*a* and 2*b* are made to be the same, the pressures may be configured to fall within previously determined allowable values other than the case of the same pressures.

As described above, the back pressure room 12 communicates with the external line side compression room 2*a* at the communicating section A, and communicates with the internal line side compression room 2*b* at the communicating section B. Variations in the pressures of the respective compression rooms 2*a* and 2*b* in communication can be made to the same as shown in FIG. 6 by controlling the communicating sections A and B in this way, and a stable back pressure can be maintained by reducing a variation in the pressure in the back pressure room 12.

In FIG. 6, a bold line indicates an actual pressure (actual back pressure) of the back pressure room 12, and the pressure in the back pressure room 12 is changed as indicated by the bold line in correspondence with the orbiting angle of the orbiting scroll 6. Incidentally, in FIG. 6, a bold one-dotted chain line indicates a design pressure (design back pressure) of the back pressure room 12, a one-dotted chain line indicates pressures in compression rooms when the external line side compression room 2*a* and the internal line side compression room 2*b* start communicating with the back pressure room 12, and a two-dotted chain line indicates pressures in the compression rooms when the external line side compression room 2*a* and the internal line side compression room 2*b* finish communicating with the back pressure room 12.

As shown in FIG. 6, according to the present embodiment, the pressure near to the design back pressure can be maintained, a force of pushing up the orbiting scroll 6 is stabilized by stabilizing the back pressure, and a face pressure of the sliding face of the orbiting scroll 6 and the fixed scroll 5 can be made to be uniform. Therefore, the face pressure of a proper magnitude can be maintained, and a reduction in the sliding loss and an improvement in the reliability of the sliding face can be achieved.

Incidentally, the communicating sections A and B can be controlled by changing the shape of the communicating section control groove 51 provided at the face of the base plate 5*a* of the fixed scroll 5, and the communicating section A of the communicating section control groove 51 and the fluid outflow path 41*a* for the external line room, and the communicating section B of the communicating section control groove 51 and the fluid outflow path 41*b* for the internal line room can be adjusted.

Particularly, when the scroll compressor is operated at a low speed, a long period of time is taken for a compressing step at one time, and therefore, a communicating time period in the communicating section is prolonged and the pressure for the back pressure room 12 is easy to be varied. However, the pressure variation of the back pressure room 12 can be reduced by using the present embodiment, and therefore, the face pressure of the sliding face of the orbiting scroll 6 and the fixed scroll 5 can be made to be uniform to be the proper face pressure, and a high energy efficiency can be realized by reducing a sliding loss. Therefore, there can be configured a scroll compressor mounted with a motor which is specified to have a ferrite magnet having a low motor efficiency in low speed operation (motor using ferrite magnet at rotor). The following effect is also achieved by configuring the scroll compressor mounted with the motor specified to have the ferrite magnet.

In recent times, adoption of an R32 refrigerant (single refrigerant) having a low global worming potential (GWP) is investigated as a refrigerant for refrigeration or air conditioning. When the R32 refrigerant is used as a refrigerant of a compressor, a compressor delivery gas temperature is higher than that in a refrigerant of R22, R410A or the like by about 20° C. through 30° C. When the delivery temperature is high, a surrounding temperature of a motor in a hermetically closed vessel is elevated, and in a case of using a neodymium magnet for a rotor of the motor, the surrounding temperature of the motor exceeds a demagnetizing heat resistant temperature of the neodymium magnet, and therefore, an irreversible demagnetization is liable to be brought about. When the irreversible demagnetization is brought about, there causes a problem of bringing about a reduction in an efficiency, and a temperature rise by increasing a current of a motor winding.

However, in a case of using a ferrite magnet for a rotor of a motor, the ferrite magnet has a property difficult to be brought into the irreversible demagnetization even at a high temperature. Therefore, even when the ferrite magnet is at a high temperature by using the R32 refrigerant, there is no concern of demagnetization. Therefore, a performance of a compressor can be maintained even in a scroll compressor using R32 as a refrigerant.

Incidentally, it is necessary for the communicating sections of the fluid outflow paths 41*a* and 41*b* to prevent simultaneous communication of the two fluid outflow paths 41*a* and 41*b*. Also, when the pressure in the compression room is higher than the pressure in the back pressure room, a back flow of oil from the compression room to the back pressure room is brought about, and therefore, it is necessary to reduce the back flow. Therefore, according to the present embodiment, the communicating sections of the two fluid outflow paths 41*a* and 41*b* are preferably made to be equal to or more than 45° and less than 180°, more preferably, equal to or more than 90° and less than 180°. Also, although an explanation has been given of an example in which the communicating section A of the external line side compression room is made to be 150°, and the communicating section B of the internal line side compression room is made to be 90° explained in FIG. 5 and FIG. 6, the lengths of the communicating sections are not limited thereto.

Figure 7:
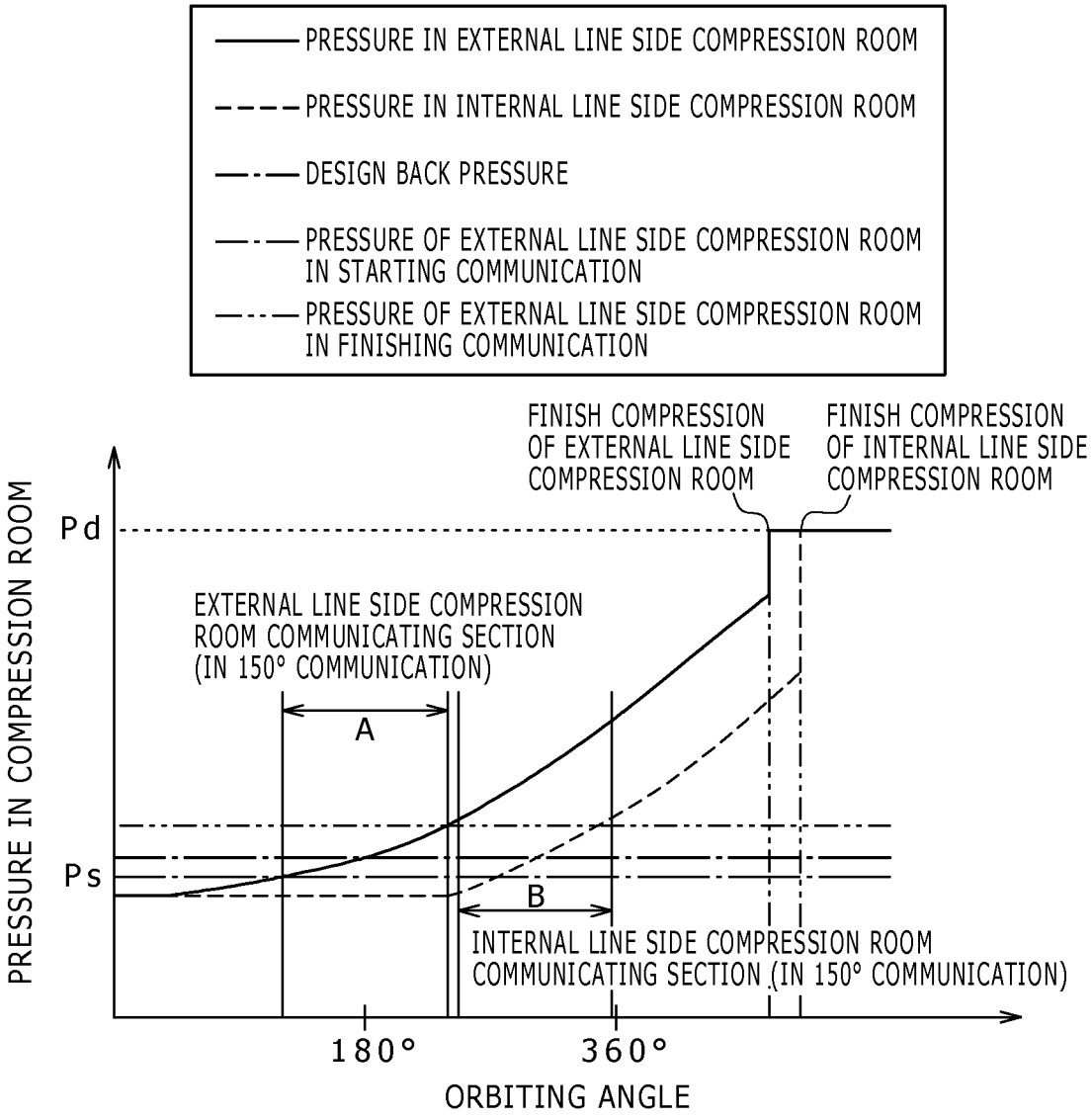
FIG. 7 is a diagram for explaining a relationship between the orbiting angle and the pressure in the compression room of the scroll compressor which has been investigated initially and is a diagram for explaining the communicating section of the back pressure room fluid outflow path.
Figure 8:
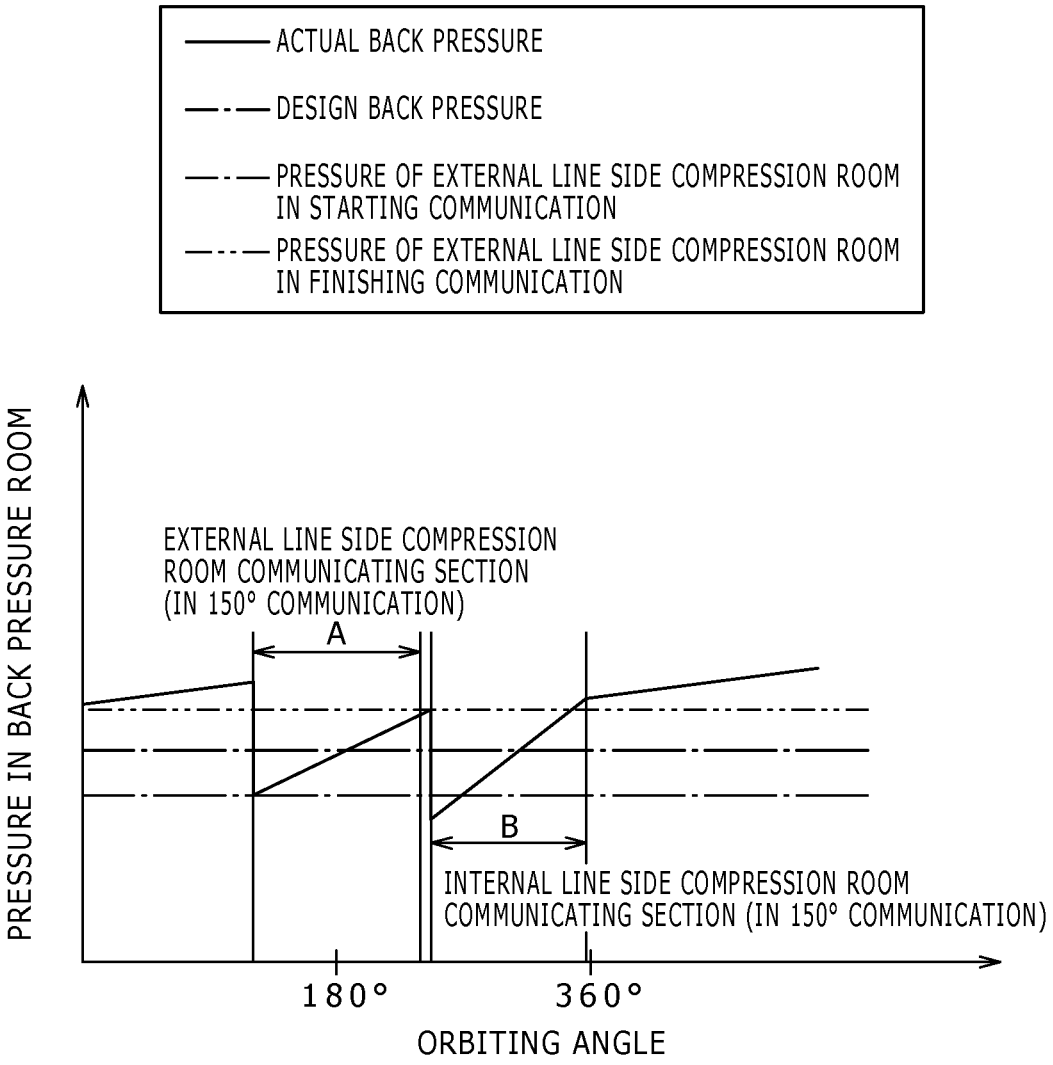
FIG. 8 is a diagram showing a relationship between the orbiting angle and the pressure in the back pressure room in the scroll compressor which has been investigated initially.

Here, an explanation will be given of a communicating section of a back pressure room fluid outflow path of a scroll compressor which has been initially investigated in reference to FIG. 7 and FIG. 8. FIG. 7 is a diagram for explaining a relationship between an orbiting angle and a pressure in a compression room of a scroll compressor which has been initially investigated, and is a diagram for explaining the communicating section of the back pressure room fluid outflow path. FIG. 8 is a diagram for explaining a relationship between an orbiting angle and a pressure in a back pressure room of a scroll compressor which has been initially investigated. In FIG. 7 and FIG. 8, respective lines and signs and the like are similar to those of FIG. 5 and FIG. 6.

As shown in FIG. 7, according a proposal which has been investigated initially, both of the communicating section A of the external line side compression room and the communicating section B of the internal line side compression room are made to be 150°. However, in a case where the communicating section B is made to be the same as the communicating section A, as shown in FIG. 8, a pressure variation in the back pressure room at the communicating section B of the internal line side compression room is increased. That is, a pressure change in the internal line side compression room is steeper than a pressure change in the external line side compression room. When lengths of the communicating sections A and B are the same, the pressure variation in the back pressure room is also increased by an amount of an increase in the pressure change on the side of the internal line side compression room.

Hence, according to the present embodiment, the pressure variation in the back pressure room 12 is made to be able to be restrained to be small at either of the communicating sections A and B by making the communicating section B of the internal line side compression room 2*b* shorter than the communication section A of the external line side compression room 2*a* as has been explained in reference to FIG. 5 and FIG. 6.

As has been explained above, according to the present embodiment, the communicating section control groove 51 is configured to set the respective inlet side openings 41*aa* and 41*ba* of the respective fluid outflow paths 41*a* and 41*b* and the communicating sections A and B communicated with the back pressure room 12 such that the pressures in the external line side compression room in starting to communicate and in finishing to communicate the external line side compression room 2*a* and the back pressure room 12, and the pressures in the internal line side compression room in starting to communicate and in finishing to communicate the internal line side compression room 2*b* and the back pressure room 12 are the same or fall within previously determined allowable values. Therefore, oil feeding amounts to the external line side compression room 2*a* and the internal line side compression room 2*b* of the orbiting scroll lap 6*b* can be made to be proper.

Oil feeding to both compression rooms of the external line side compression room 2*a* and the internal line side compression room 2*b* of the orbiting scroll 6 can be carried out firmly and properly. Therefore, a deficiency in oil feeding can be avoided, also a sealing performance between the both scrolls is improved and a leakage loss of the working fluid in a compressing operation can be restrained. A stable and proper back pressure can be maintained by restraining the pressure variation in the back pressure room 12 to be small. Therefore, the orbiting scroll 6 can be pressed to the fixed scroll 5 by a pertinent pushing force, and the slidability can be improved. According to the present embodiment, a high energy efficiency can therefore be realized.

According to the embodiment, it is not necessary to provide an oil feeding path for making a fluid in the back pressure room flow out to an inner portion of the scroll lap, or provide an oil feeding hole at an upper face of the lap as described in Japanese Unexamined Patent Application Publication No. 2010-203327. Therefore, a strength of the lap is not deteriorated, and also a leakage loss at a lap tooth tip can be reduced.

According to the present embodiment, a scroll compressor capable of ensuring a high reliability and capable of realizing also a high energy efficiency can therefore be provided.

Second Embodiment

Figure 9:
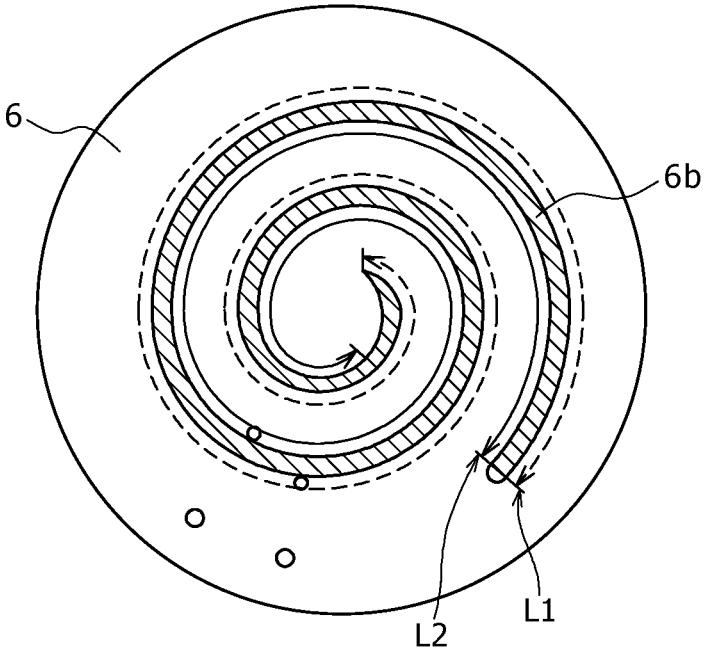
FIG. 9 is a view for explaining a second embodiment of a scroll compressor according to the present invention, and is a plane view viewing an orbiting scroll from a lap side.
Figure 10:
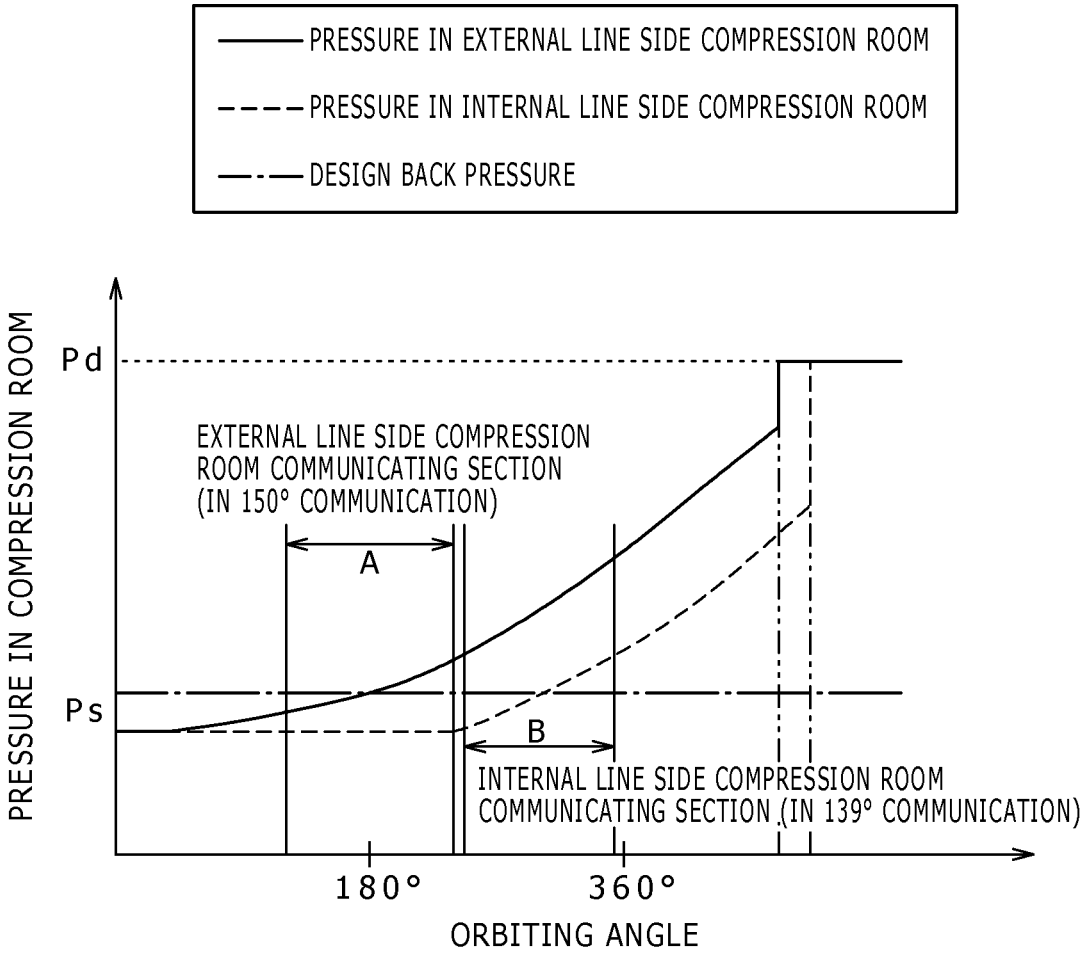
FIG. 10 is a diagram for explaining a relationship between an orbiting angle and a pressure in a compression room according to the second embodiment of the present invention; and is a diagram for explaining a communicating section of a back pressure room fluid outflow path.

An explanation will be given of a second embodiment of a scroll compressor according to the present invention in reference to FIG. 9 and FIG. 10. FIG. 9 is a view for explaining the second embodiment of the scroll compressor of the present invention, and is a plane view viewing an orbiting scroll from a lap side. FIG. 10 is a diagram for explaining a relationship between an orbiting angle and a pressure in a compression room according to the second embodiment of the present invention, and is a diagram for explaining a communicating section of a back pressure room fluid outflow path.

In explaining the second embodiment, the explanation will be given centering on a point which differs from the first embodiment described above, and the explanation will be omitted of other portion since the other portion is similar to that of the first embodiment. Also, in explaining the second embodiment, the explanation will be given by citing also a sign or the like used in the first embodiment, and a portion using a sign the same as that of the first embodiment is a portion the same as that of the first embodiment or a portion corresponding to that of the first embodiment.

According to the first embodiment described above, the pressure in the back pressure room 12 is stabilized by controlling the communicating sections A and B such that the pressures in starting to communicate and in finishing to communicate the external line side compression room 2*a* of the orbiting scroll 6 and the back pressure room 12 is the same as the pressures in starting to communicate and in finishing to communicate the internal line side compression room 2*b* and the back pressure room 12 or fall within a previously determined allowable value.

In contrast thereto, according to the second embodiment, the communicating section control groove 51 of the first embodiment is configured to control the communicating sections A and B communicating the respective inlet side openings 41*aa* and 41*ba* of the respective fluid outflow paths 41*a* and 41*b* and the back pressure room 12 such that a ratio of a time period of communicating the external line side compression room 2*a* and the back pressure room 12 (length of communicating section) to a time period of communicating the internal line side compression room 2*b* and the back pressure room 12 (length of communicating section) becomes the same as a ratio of an external line side length to an internal line length of the lap 6*b* of the orbiting scroll 6 configuring the respective compression rooms 2*a* and 2*b* or falls within a previously determined allowable value.

A specific explanation will be given in reference to the drawings as follows.

According to the second embodiment, as shown in FIG. 10, an average pressure in the communicating section A communicating the external line side compression room 2*a* of the orbiting scroll 6 and the back pressure room 12, and an average pressure in the communicating section B communicating the internal line side compression room 2*b* and the back pressure room 12 are set to be aimed pressures.

Also, a ratio of the communicating section A communicating the external line side compression room 2*a* and the back pressure room 12 to the communicating section B communicating an internal line side compression room 2*b* and the back pressure room 12 shown in FIG. 10 is set to be the same as a ratio of a length L1 of an external line of the lap 6*b* of the orbiting scroll 6 (range of broken arrow mark) to a length L2 of an internal line of the lap 6*b* of the orbiting scroll 6 (range of bold line arrow mark) shown in FIG. 9 or falls within a previously determined allowable value.

For example, in a case where a ratio "L1/L2" of the length of the external line of the lap 6*b* of the orbiting scroll 6 (a length of a lap of a portion of configuring the external line side compression room 2*a*) L1 to the length of the internal line of the lap 6*b* of the orbiting scroll 6 (a length of a lap of a portion configuring the internal line side compression room 2*b*) L2 shown in FIG. 9 is 1.08, when the communicating section A communicating the external line side compression room 2*a* and the back pressure room 12 is 150°, the communicating section B communicating the internal line side compression room 2*b* and the back pressure room 12 is configured to be expressed as follows.

$$150°/1.08=139°$$

Oil feeding to respective compression rooms 2*a* and 2*b* is carried out as sealing for preventing leakage of the working fluid between the compression rooms. A proper oil feeding amount is therefore determined by a length of a compressing step. Also, excessive oil feeding amounts to an increase in a load on the scroll by compressing the oil, or a loss of overheating by feeding a high temperature oil into the compression room, and therefore, the proper oil feeding amount needs to be determined.

A length of the compressing step is determined by lengths of the laps (vortex portions) 6*b* of the orbiting scroll 6 configuring the respective compression rooms. Hence, according to the second embodiment, the oil feeding amount is configured to adjust, that is, the communicating sections A and B are configured to adjust in accordance with lengths of laps of the orbiting scroll configuring the respective compression rooms.

Incidentally, the communicating sections A and B can be controlled by changing a shape of the communicating section control groove 51 provided at the face of the base plate 5*a* of the fixed scroll 5, and the communicating section A communicating the communicating section control groove 51 and the fluid outflow path 41*a* for the external line room as well as the communicating section B communicating the communicating section control groove 51 and the fluid outflow path 41*b* for the internal line room can be adjusted similar to the first embodiment.

There also is means for adjusting path diameters of the fluid flow path 41*a* for the external line room and the fluid outflow path 41*b* for the internal line room as a method of adjusting amounts of feeding oil to the respective compression rooms 2*a* and 2*b*. However, respective pressure losses thereof differ from each other, and therefore the back pressure is liable to be unstable, which is not preferable.

According to the second embodiment, the amount of feeding oil to the external line side compression room 2*a* and the amount of feeding oil to the internal line side compression room 2*b* are distributed by the ratio of the external line lengths L1 to the internal line length L2 of the lap 6*b* of the orbiting scroll 6 configuring the compression rooms. The oil feeding amounts can therefore be made to be proper in accordance with the lengths of the laps configuring the respective compression rooms 2*a* and 2*b*. Thereby, the sealing performance between the both scrolls is improved, and a heating loss can be reduced by restraining the leakage loss of the working fluid. The stable and proper back pressure can be maintained by restraining the pressure variation of the back pressure room 12 to be small, the orbiting scroll 6 can be pressed to the fixed scroll 6 by a pertinent pushing force, and also the slidability can be improved.

Particularly, the second embodiment is effective for a scroll compressor for refrigeration or air conditioning which uses a refrigerant having a low density of R32 or the like. That is, although the refrigerant having the low density is easy to be leaked, the sealing performance can further be improved more than that of a case of the first embodiment by adopting the present embodiment, and therefore, the efficiency in using the R32 refrigerant can further be improved.

An effect similar to that of the first embodiment is achieved.

Therefore, the second embodiment can also provide a scroll compressor capable of making the amounts of feeding oil to the external line side compression room and the internal line side compression room of the orbiting scroll lap proper, capable of ensuring the high reliability, and also capable of realizing the high energy efficiency without deteriorating the strength of the lap.

As explained above, according to the respective embodiments of the present invention, the stable back pressure can be ensured, the orbiting scroll pressing force can be made to be proper, and the amounts of feeding oil to the respective compression rooms can be made to be proper. Therefore, the present invention can realize a scroll compressor having a high energy efficiency and a high reliability by adopting the present embodiments of the present invention for a scroll compressor which needs to improve a performance at the low speed operation, or a scroll compressor using a low density refrigerant of R32 or the like.

In this way, the respective embodiments of the present invention can provide a scroll compressor capable of making amounts of feeding oil to the external side compression room and the internal line side compression room of the orbiting scroll lap proper without deteriorating the strength of the lap.

What is claimed is:

1. A scroll compressor comprising:

a fixed scroll; and an orbiting scroll, wherein the scroll compressor configures a suction room and a compression room between the fixed scroll and the orbiting scroll by bringing the fixed scroll and the orbiting scroll formed by erecting laps in a spiral shape on base plates in mesh with each other, reducing to press a volume of the compression room by moving to orbit the orbiting scroll, and having a back pressure room a pressure of which is higher than a pressure of the suction room on a back face of the base plate of the orbiting scroll, shapes of the laps of the fixed scroll and the orbiting scroll are formed by an asymmetric tooth shape in which orbiting angles of an external line side compression room formed on an external line side of the orbiting scroll lap and an internal line side compression room formed on an internal line side of the orbiting scroll lap in finishing suction differ from each other, a fluid outflow path for the external line side compression room communicating with the external line side compression room of the orbiting scroll lap, and a fluid outflow path for the internal line side compression room communicating with the internal line side compression room of the orbiting scroll lap are formed on the base plate of the orbiting scroll, openings on outlet sides of the respective fluid outflow paths open to a lap tooth bottom of the orbiting scroll configuring the compression room, openings on inlet sides of the respective fluid outflow paths open to a face of the base plate of the orbiting scroll sliding in contact with a sliding face of the base plate of the fixed scroll, a face of the base plate of the fixed scroll in contact with the base plate of the orbiting scroll is formed with a communicating section control groove that intermittently communicates the respective inlet side openings of the fluid outflow path for the external line side compression room and the fluid outflow path for the internal line side compression room and the back pressure room in accordance with a movement of orbiting the orbiting scroll, and the communicating section control groove controls the communicating sections communicating the respective inlet side openings of the respective fluid outflow paths and the back pressure room such that a ratio of a time period of communicating the external line side compression room and the back pressure room to a time period of communicating the internal line side compression room and the back pressure room becomes the same as a ratio of an external line length to an internal line length of the lap of the orbiting scroll configuring the respective compression rooms.

2. The scroll compressor according to claim 1, wherein the back pressure room and the external line side compression room as well as the internal line side compression room are intermittently communicated with each other within a range of the orbiting angle in which pressures of the respective compression rooms become aimed pressure states.

3. The scroll compressor according to claim 2, wherein the communicating section control groove for intermittently communicating the back pressure room and the external line side compression room, and the communication section control groove for intermittently communicating the back pressure room and the internal line side compression room are formed by a common groove.

4. The scroll compressor according to claim 3, further comprising:

a motor for moving to orbit the orbiting scroll, wherein the motor uses a ferrite magnet for a rotor thereof.

5. The scroll compressor according to claim 4, wherein the scroll compressor is used as a compressor for compressing a refrigerant for refrigeration or air conditioning and an R32 refrigerant is used as the refrigerant.

* * * * *